United States Patent [19]

Nagase

[11] 3,991,533

[45] Nov. 16, 1976

[54] LOUVER ASSEMBLY

[75] Inventor: Mitsuo Nagase, Kurobe, Japan

[73] Assignee: Yoshida Kogyo K.K., Tokyo, Japan

[22] Filed: Aug. 6, 1975

[21] Appl. No.: 602,409

[30] Foreign Application Priority Data

Aug. 13, 1974 Japan ..... 49-96788

[52] U.S. Cl. ..... 52/473; 52/663; 98/121 R

[51] Int. Cl.[2] ..... E06B 7/08

[58] Field of Search ..... 52/473, 78, 75, 663; 98/121 R, 87, 99.8

[56] References Cited

UNITED STATES PATENTS

| | | | |
|---|---|---|---|
| 725,042 | 4/1903 | Clark | 98/121 R |
| 1,784,841 | 12/1930 | Landau | 52/473 X |
| 2,506,978 | 5/1950 | Unterberger | 98/87 X |
| 2,987,985 | 6/1961 | Johnson | 52/473 X |
| 3,120,036 | 2/1964 | Minds, Jr. | 52/473 |
| 3,217,631 | 11/1965 | Thompson et al. | 52/473 X |
| 3,394,518 | 7/1968 | Worrell, Jr. | 52/473 |
| 3,771,430 | 11/1973 | Lane | 52/473 X |

FOREIGN PATENTS OR APPLICATIONS

| | | | |
|---|---|---|---|
| 352,561 | 7/1931 | United Kingdom | 52/473 |

*Primary Examiner*—Price C. Faw, Jr.
*Assistant Examiner*—Leslie A. Braun
*Attorney, Agent, or Firm*—Hill, Gross, Simpson, Van Santen, Steadman, Chiara & Simpson

[57] ABSTRACT

A combination louver and window sash assembly includes a plurality of louver boards extending horizontally and each having a cross-section of substantially inverted-Y shape. A pair of parallel, vertical sash frames having vertically extending slots faced in opposed relation to one another and including pairs of cutout recesses formed in the marginal edges of the slots. The louver boards have their horizontal ends thrusted resiliently through the slots and received snappingly in the cutout recesses.

6 Claims, 3 Drawing Figures

LOUVER ASSEMBLY

BACKGROUND OF THE INVENTION

1. Field of the Invention

This invention relates to ventilation devices and, more particularly, a louver assembly attached to a window sash.

2. Prior Art

The louver assembly of the type described has been widely used for attachment to window assemblies, such for example as sliding windows, casements or fixed windows. However, the prior art louver assembly required a suitable adapter or attachment which puts the louver boards securely together to form an integral unit which is in turn assembled into the window sash. This construction has the disadvantage that the louver assembling operation is rather complicated and hence becomes objectionably slow.

SUMMARY OF THE INVENTION

A principal object of this invention is therefore to provide a louver assembly which can be attached to a window sash without the aid of any intermediate adapter or attachment.

Another object of the invention is the provision of a louver assembly of which louver boards are fitted directly in cutout recesses formed in the stiles of a window sash.

A further object of the invention is to provide a louver assembly which can be easily and speedily attached to a window sash.

Many other advantages and features of the present invention will become manifest to those versed in the art upon making reference to the detailed description of the accompanying drawings in which like reference numerals denote like parts throughout the several views.

DETAILED DESCRIPTION OF THE PREFERRED EMBODIMENT

Figure 1:
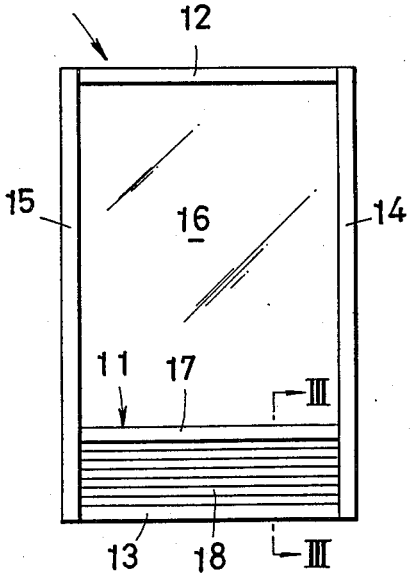
FIG. 1 is a front elevational view of a window sash having a louver assembly provided in accordance with the invention.

As shown in the drawings and in FIG. 1 in particular, a window sash 10 has at its lower end a louver assembly 11 constructed according to the invention. The sash 10 basically includes a top rail 12, a bottom rail 13, a pair of vertically extending parallel frames or stiles 14 and 15, and a window pane 16 held in place by these frame members. The sash 10 may be set into a window assembly (not shown), such for example as a sliding window, a casement or a fixed window in the usual manner. A dividing rail 17 extends horizontally between the stiles 14, 15 and is spaced upwardly from the bottom rail 13. Interposed between the dividing rail 17 and the bottom rail 13 are a group of parallel louver boards 18 extending horizontally between the stiles 14 and 15. The louver assembly 11 is formed principally with the louver boards 18 as is described below.

Figure 2:
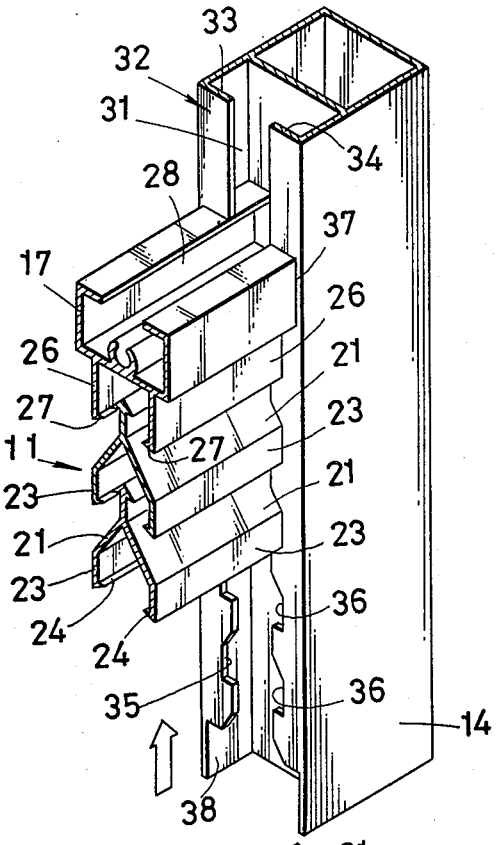
FIG. 2 is a fragmentary, exploded perspective view of the louver assembly.
Figure 3:
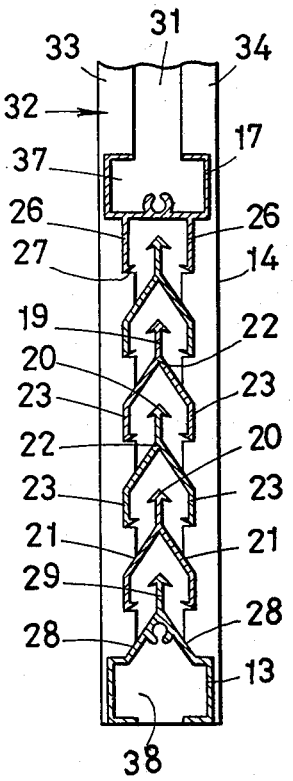
FIG. 3 is an enlarged vertical cross-sectional view taken along the line III—III of FIG. 1.
Figure 3:
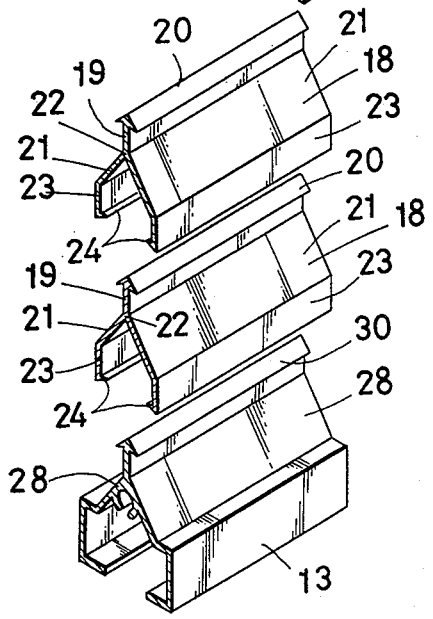

As shown in FIGS. 2 and 3, each louver board 18 has a cross-section of a substantially inverted-Y shape and includes an upwardly extending vertical member or projection 19 which is provided at its upper end with a flashing 20 of an arrow-head-shaped cross-section. The louver board 18 includes a pair of bifurcations 21 extending from a merging point 22 and each having at its lower end a vertical wall 23 extending downwardly therefrom and terminating in an inwardly directed water drip lip 24. The dividing rail 17 is provided at its underside with a pair of vertical walls 26 projecting downwardly therefrom and each terminating in a similar water drip lip 27. A slot is formed in and extends longitudinally of the dividing rail 17 and is adapted to receive the lower peripheral edge of the window pane 16. The bottom rail 13 includes a pair of bifurcations 28 extending upwardly therefrom and is formed structurally similar to the louver boards 18. The bifurcations 28 merge in a vertical member 29 which is provided at its upper end with a cross-sectionally arrow-head-shaped flashing 30.

The structural details of the stiles 14 and 15 are shown in FIG. 2. Since the stiles 14 and 15 are completely identical in construction, only the stile 14 will now be discussed. The stile 14 is of a rectangular cross-section and has a vertically extending slot 31 formed centrally in and along its one surface 32 facing the stile 15. Formed in and along marginal edges or flanges 33 and 34 are a plurality of pairs of respective cutout recesses or indents 35 and 36, which pairs are vertically spaced a given distance apart from each other. The cutout recesses 35, 36 are so defined as to receive snugly therein longitudinal ends of the louver boards 18 in each pair. The stile 14 is further provided with cutout recesses 37 and 38 for fitting engagement with longitudinal ends of the rails 17 and 13, respectively. The portion of the slot 31 which extends upwardly beyond the dividing rail 17 is adapted to receive a lateral marginal edge of the window pane 16.

With the above-noted structure, the dividing rail 17 is first brought into fitting engagement with the cutout recesses 37 of the stiles 14 and 15. The louver boards 18 are then orientated in vertically aligned relation with respect to each other as indicated by the arrow and fitted one after another into the pairs of cutout recesses 35, 36 of the stiles 14 and 15. At this time, the bifurcations 21 and the vertical walls 23 of each louver board 18 are resiliently thrusted through the slot 31 into snapping engagement with the cutout recesses 35, 36. After attachment of all of the louver boards 18 to the stiles 14 and 15, the bottom rail 13 is finally inserted into the cutout recesses 38 of the stiles 14 and 15, thereby completing the entire louver assembly 11. The louver assembly 11 of the invention can be attached directly to the sash 10 without the aid of any adapter or attachment and hence the speed of assembling of the louver components is increased.

FIG. 3 shows that the louver boards 18 when attached to the sash 10 are vertically aligned with and spaced an appropriate distance apart from each other. The projection 19 of any one of the louver boards 18 extends upwardly between the walls 23, but terminates short of the merging point 22 of an adjoining louver board 18, so that the attached louver boards 18 can prevent rain and wind from blowing into the interior of the building and at the same time can provide the requisite ventilation. The louver components employed in accordance with the invention may preferably be made of a plastic or similar resilient material such that the components can yield during their assembling operation.

While the invention has been described by way of example only, it will be understood that various changes or modifications may be made in the precise form and construction herein advanced without departing from the scope of the appended claims.

What is claimed is:

1. A combination louver and window assembly, comprising:

a. a pair of vertical stiles having vertically extending slots facing each other;

b. three parallel rails, one joining the upper ends of said stiles, one joining intermediate points on said stiles, and one joining the lower ends of said stiles;

c. a panel encircled by and received within a portion of said vertical stiles, within the intermediate one of said rails and one of the other of said rails;

d. said stiles, remotely from said panel, having opposed pairs of vertically aligned recesses in the marginal edges defining said slots, said pairs being vertically spaced, said recesses being symmetrical in shape relative to the vertical slots; and e. a plurality of horizontal louver boards held at opposite ends in opposed pairs of said recesses in said vertical stiles, and disposed between said intermediate rail and the other of said rails, said louver boards having a cross-section of inverted Y-shaped configuration having two downwardly extending legs fitting into a pair of said opposed symmetrical recesses, and an upwardly extending leg extending between the downwardly extending legs of an adjacent louver board in spaced relation thereto.

2. A combination louver and window assembly according to claim 1, each said louver board having a flashing of upwardly pointing arrow-head configuration extending along the upper edge of said upwardly extending leg.

3. A combination louver and window assembly according to claim 1, each said louver board having drip lips extending toward each other along the lower ends of said downwardly extending legs.

4. A combination louver and window assembly according to claim 1, the one of said rails lying just above said louver boards having elongated flanges corresponding to the legs of said inverted Y-shaped configuration and disposed at opposite sides of said upwardly extending leg of the uppermost one of said louver boards.

5. A combination louver and window assembly according to claim 1, the one of said rails lying just below said louver boards having an elongated flange corresponding to the upwardly extending leg of said inverted Y-shaped configuration and disposed between the downwardly extending legs of the lowermost one of said louver boards.

6. A combination louver and window assembly according to claim 1, said rails being held in further symmetrical recesses of complemental configuration in said marginal edges of said stiles.

* * * * *